United States Patent [19]

Michaels

[11] 3,995,666

[45] Dec. 7, 1976

[54] METHOD FOR FILLING AEROSOL SPRAY DISPENSERS

[75] Inventor: Robert E. Michaels, Addison, Ill.

[73] Assignee: VCA Corporation, Baton Rouge, La.

[22] Filed: Dec. 24, 1975

[21] Appl. No.: 644,347

[52] U.S. Cl. ..... 141/3; 141/20

[51] Int. Cl.[2] ..... B65B 31/00

[58] Field of Search ..... 141/3, 20, 128, 49, 141/54, 2, 18, 63, 64, 59

[56] References Cited

UNITED STATES PATENTS 3,234,707 2/1966 Weston ..... 141/20

*Primary Examiner*—Houston S. Bell, Jr.

*Attorney, Agent, or Firm*—Donald L. Johnson; John F. Sieberth; David L. Ray

[57] ABSTRACT

A method for rapidly filling an aerosol spray dispenser containing a liquid with a soluble gas propellant including lifting the cap off the container and injecting the propellant into the container at a velocity sufficient to substantially saturate the liquid with the propellant.

3 Claims, 6 Drawing Figures

METHOD FOR FILLING AEROSOL SPRAY DISPENSERS

BACKGROUND OF THE INVENTION

This invention relates to the addition of a soluble gaseous propellant to an aerosol container. In particular, the present invention relates to the addition of soluble compressed gas such as carbon dioxide, nitrous oxide or the like to aerosol dispensers.

Compressed gases such as carbon dioxide and nitrous oxide have long been used as propellants for aerosol dispensers. However, the use of such propellants has recently become much more widespread partly due to speculation about possible damage to the ozone belt caused by fluorocarbon propellants.

Although such compressed gas propellants have been used for a long time, there has not been generally available a high speed technique for filling dispensers. Conventional processes for filling aerosol dispensers with compressed gases such as carbon dioxide and nitrous oxide include shaking the dispenser while the gas is being added to dissolve the gas in the liquid. Another method includes saturating a liquid with the gas prior to adding the saturated liquid to the dispenser. An additional method includes injecting the gas through the actuator button or stem opening at high speeds bordering on instantaneous injection to dissolve the gas (sometimes referred to as impact gasing). However, such conventional processes are undesirably slow and expensive when compared to the process of the present invention. Impact gasing limits valve design and with it delivery capabilities.

SUMMARY OF THE INVENTION

In accordance with the present invention, there is provided a method for rapidly filling an aerosol spray dispenser containing a liquid with a soluble gaseous propellant including lifting the cap off the container and injecting a propellant into the container at a velocity sufficient to substantially saturate the liquid with the propellant by regulating the distance between the cap and the container.

BRIEF DESCRIPTION OF THE DRAWINGS

The invention will be more completely understood by reference to the drawings in which.

DESCRIPTION OF THE PREFERRED EMBODIMENTS

Figure 1:
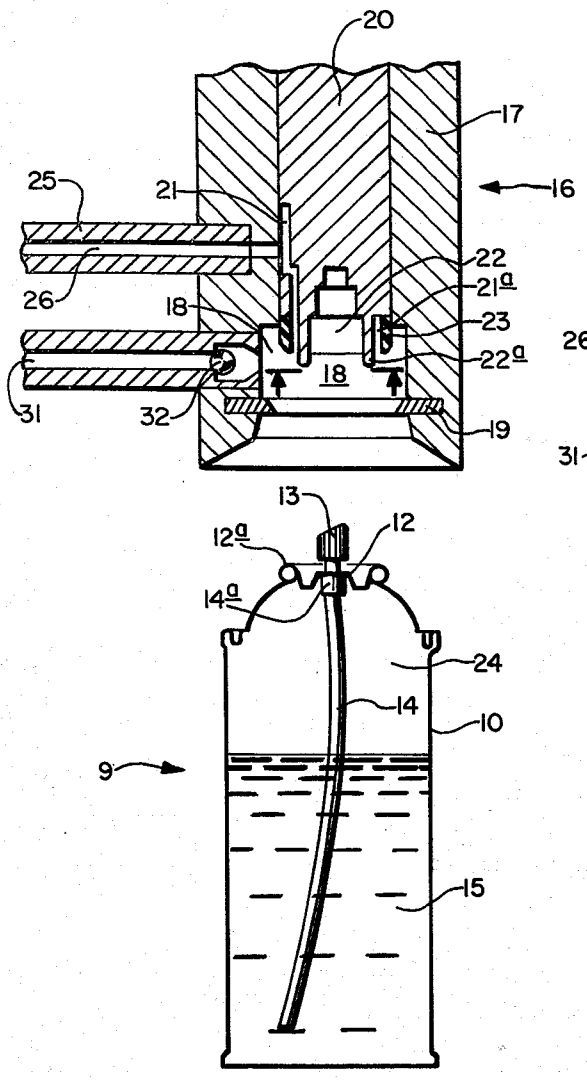
FIG. 1 is a sectional, side view of an aerosol dispenser positioned below a propellant filling apparatus.

In FIG. 1 is shown an aerosol dispenser generally indicated by the numeral 9. The aerosol dispenser includes a can 10 containing a liquid 15. Located above the liquid 15 is space 24 which is filled with air. The can 10 has a tapered top 11 connected thereto by crimping or any other desired method.

The dispenser assembly is placed on top 11 and mounting cup 12 is loosely positioned thereon for connection at a later time by crimping or any other desired method. Mounting cup 12 holds actuator button 13 which is depressed to spray liquid 15 after the dispenser is filled with propellant. During spraying, the liquid 15 reaches actuator button 13 through a tube 14 and valve member 14a.

Figure 2:
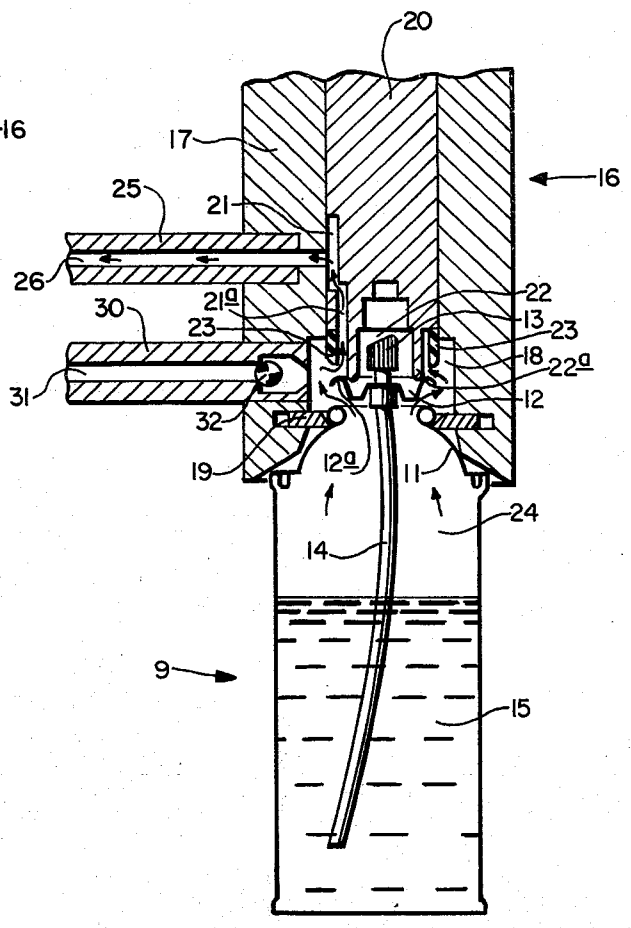
FIG. 2 is a sectional, side view of an aerosol dispenser in contact with the propellant filling apparatus with the cap lifted from the aerosol dispenser while evacuating the residual air from the dispenser.

Located immediately above aerosol dispenser 9 is an under cap filling apparatus generally indicated by the numeral 16, including head 17. Any suitable conventional filling apparatus may be used in carrying out the process of the present invention. The filling apparatus 16 includes a hollow chamber 18 formed in the lower part of head 17 into which cup 12 and actuator button 13 fit when aerosol dispenser 9 is engaged as indicated in FIG. 2. Chamber 18 also has a resilient circular sealing member 19 thereon which contacts top 11 to form a seal therewith as shown in FIG. 2.

Located above chamber 18 and inside head 17 is movable inner bell 20. Inner bell 20 also has a chamber 22 therein defined by cylindrical walls **22*a* for receipt of actuator button 13 as shown in FIGS. 2–5.**

Connected to the lower end of inner bell 20 is an annular flexible seal member 23. Flexible seal 23 is attached to inner bell 20 in any conventional manner and may be made of any desired flexible material such as rubber, plastic or the like. Flexible seal 23 forms the outside wall of circular chamber 21a.

Also rigidly connected to head 17 is previously mentioned vacuum line 25 which is connected to a vacuum source (not shown). Located below vacuum line 25 and rigidly connected to head 17 is propellant line 30 having an inlet passage 31 therein and a check valve 32 at one end thereof.

The filling sequence of the aerosol dispenser is shown in FIGS. 1 through 5. In FIG. 1 the aerosol can 10 has previously been partially filled with a liquid 15 at a product filling station (not shown). The dispenser assembly including mounting cup 12, actuator button 13 and tube 14 is then loosely placed on top 11.

Head 17 is then engaged with top 11 as shown in FIG. 2. Head 17 contacts top 11 and sealing member 19 forms a seal therewith. Vacuum is then applied to chamber 18 through vacuum line 25 and inlet passage 26. The application of the vacuum through line 26 causes air to flow from air space 24 upward around the bottom of mounting cup 12, upward through circular chamber **21*a* and channel 21, and outward through vacuum inlet passage 26 as indicated by the arrows in FIG. 2. The upward rush of air from can 10 forces mounting cup 12 upward into the position indicated in FIG. 2 and against cylindrical wall 22*a*. Wall 22*a* contacts cup 12 and prevents the cup from making a seal with seal 23.**

Figure 3:
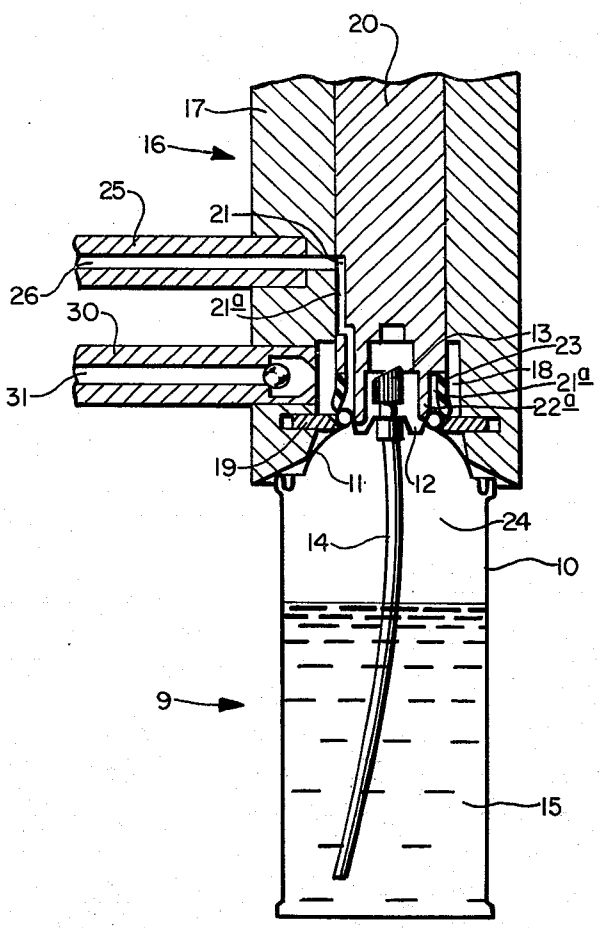
FIG. 3 is a sectional, side view of an aerosol dispenser cap in contact with the propellant filling apparatus at completion of evacuation part of cycle just prior to filling.
Figure 4:
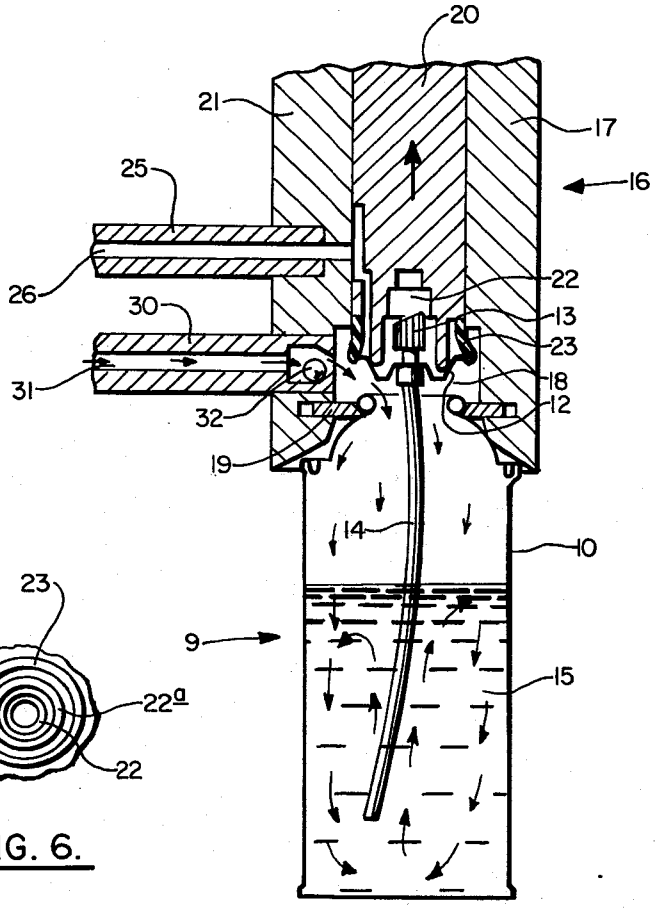
FIG. 4 is a view of an aerosol dispenser in contact with a gaseous propellant filling apparatus wherein the propellant is being introduced into the container.
Figure 6:
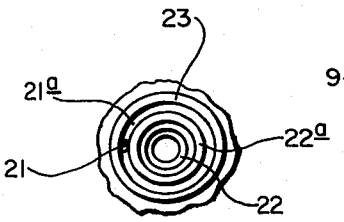
FIG. 6 is a sectional view taken along lines 6—6 of FIG. 1.

As shown in FIG. 3, inner bell 20 then travels downward with respect to can to force seal member 23 against the top of cup 12 thus forming seal with cup 12 and chamber **21*a*. As seen in FIG. 4, inner bell 20 is then moved upwardly. Cup 12 follows inner bell 20 upward. A suitable propellant, for example carbon dioxide, under pressure is introduced through inlet 31 and check valve 32. The propellant flows therearound into chamber 18 and downward beneath cup 12 into can 10 as indicated by the arrows. The propellant flow helps hold cup 12 against inner bell 20. The high pressure gaseous propellant strikes the surface of the liquid 15 causing intense agitation and mixing of the liquid 15** with the propellant gas to cause substantial saturation of the liquid with the gas in a very short time interval.

Figure 5:
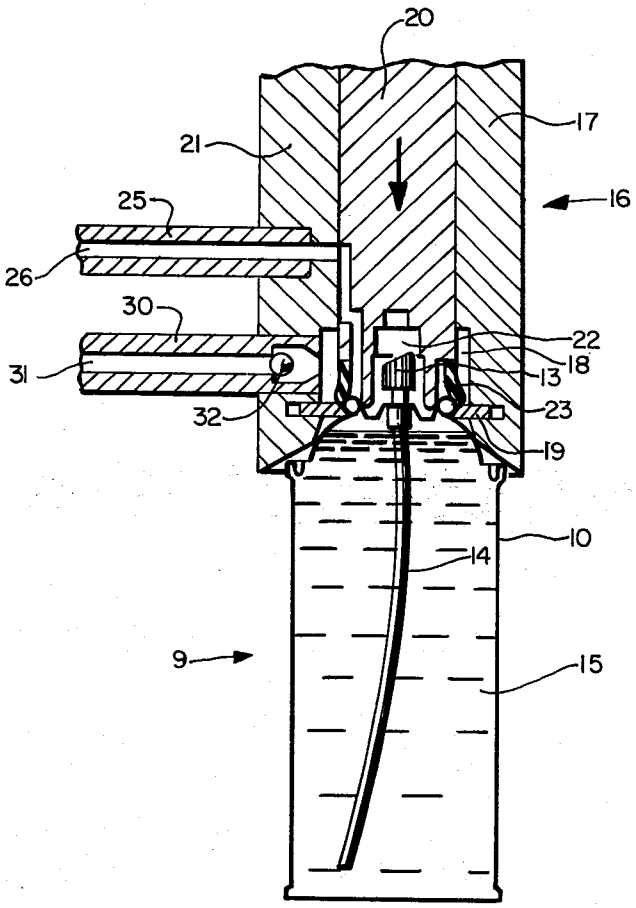
FIG. 5 is a view of an aerosol dispenser in contact with a propellant filling apparatus with the cap affixed to the top of the dispenser.

As seen in FIG. 5, after the propellant has saturated the liquid 15, the pressure drops and inner bell 20 lowers cup 12 into top 11 for crimping. Thus, the space 24 is filled with propellant gas under pressure and also propellant gas is dissolved in the liquid 15 to the limit of the solubility of the gas in the liquid. Head 17 is raised upwardly and the filled dispenser is moved from under the filling head.

It is necessary that the distance between the underside of mounting cup 12 and the rim 11a of top 11 be carefully adjusted to insure that the gaseous propellant flows therebetween at a velocity sufficient to intensely agitate the liquid 15 to produce substantial saturation of the liquid by the gas in a very short time. The correct distance or height of cup 12 above rim 11a will depend upon the volume of the liquid in the container, the solubility of the gas in the liquid, the temperature of the liquid, and the temperature, pressure, and velocity of the injected gas.

I claim:

1. In a method for rapidly pressurizing an aerosol spray container having a liquid product therein, wherein a dispensing assembly is loosely positioned on the rim of the top of the container, air is evacuated from the container, the dispensing assembly is raised from the rim, a propellant gas under pressure is introduced into the container, and the dispensing assembly is fixedly attached to the container, the improvement comprising positioning the dispensing assembly at a distance above the rim of the top of the container which will cause the pressurizing gas to enter the container at a velocity sufficient to cause intense agitation of the liquid thereby substantially saturating the liquid with the propellant gas in a very short time.

2. The method of claim 1 wherein said propellant gas is carbon dioxide.

3. The method of claim 1 wherein said propellant gas is nitrous oxide.

* * * * *